US011485033B1

(12) United States Patent
Peng

(10) Patent No.: US 11,485,033 B1
(45) Date of Patent: Nov. 1, 2022

(54) SCISSORS

(71) Applicant: Yangjiang Gangfu Industrial Co., Ltd., Guangdong (CN)

(72) Inventor: Yuegui Peng, Guangdong (CN)

(73) Assignee: YANGJIANG GANGFU INDUSTRIAL CO., LTD., Yangjiang (CN)

( * ) Notice: Subject to any disclaimer, the term of this patent is extended or adjusted under 35 U.S.C. 154(b) by 0 days.

(21) Appl. No.: 17/305,823

(22) Filed: Jul. 15, 2021

(30) Foreign Application Priority Data

Jun. 29, 2021 (CN) ..... 202121465401.6

(51) Int. Cl.
*B26B 13/28* (2006.01)

(52) U.S. Cl.
CPC ..... *B26B 13/28* (2013.01)

(58) Field of Classification Search
CPC ..... B26B 13/00; B26B 13/28; B25B 7/00; B25B 7/02–04; B25B 7/10; B25B 7/14; B25B 7/22; B25B 9/04
See application file for complete search history.

(56) References Cited

U.S. PATENT DOCUMENTS 2,837,823 A * 6/1958 Petrocelli ..... B26B 13/285 30/239
3,065,542 A * 11/1962 Zepf ..... B26B 13/28 30/266
3,453,731 A * 7/1969 Wertepny, Sr. ..... B26B 13/28 30/267
3,611,570 A * 10/1971 Laurenti ..... B26B 13/28 30/268
4,198,738 A * 4/1980 Wallace ..... B25B 7/02 29/268
4,598,477 A * 7/1986 Quick ..... B26B 13/28 30/260
4,761,883 A * 8/1988 Mertens ..... B26B 13/285 34/239
4,893,530 A * 1/1990 Warheit ..... B25B 7/16 81/413
4,914,820 A * 4/1990 Saito ..... B26B 13/28 30/239
5,005,450 A * 4/1991 Ford ..... B25B 7/14 81/324
5,033,338 A * 7/1991 Ford, Jr. ..... B25B 7/16 81/324

(Continued)

*Primary Examiner* — Sean M Michalski
*Assistant Examiner* — Richard D Crosby, Jr.
(74) *Attorney, Agent, or Firm* — Shimokaji IP

(57) ABSTRACT

A pair of scissors for opening a box includes a first cutting member and a second cutting member. The first cutting member is provided with a first handle on an end thereof, and the second cutting member is provided with a second handle on an end thereof. The scissors further include a connecting nail and a movable hole defined on the first cutting member. The movable hole is arranged for the connecting nail to move, and the connecting nail passes through the movable hole and is connected with the second cutting member, so that the first cutting member pivots around the second cutting member by the connecting nail. The connecting nail is movable in the movable hole which allows the first cutting member to move relatively to the second cutting member. The scissors have the advantages of simple structure, low cost and convenient operation.

11 Claims, 7 Drawing Sheets

(56) References Cited

U.S. PATENT DOCUMENTS 5,060,543 A * 10/1991 Warheit ..... B25B 7/10 81/321
5,119,520 A * 6/1992 Finn ..... B25F 1/003 81/319
5,297,343 A * 3/1994 Melter ..... B26B 29/04 30/151
6,450,555 B1 * 9/2002 Collister ..... F16K 7/063 292/210
6,739,217 B2 * 5/2004 Hartranft ..... B25B 7/00 81/331
7,587,963 B1 * 9/2009 Broadus ..... B25B 7/14 81/414
8,667,874 B2 * 3/2014 Steele ..... B25B 7/14 81/319
10,695,921 B2 * 6/2020 Wong ..... B26B 13/26
2003/0154552 A1 * 8/2003 Oka ..... B25B 7/10 7/127
2004/0000058 A1 * 1/2004 Shyr ..... A01G 3/02 30/261
2009/0277019 A1 * 11/2009 Mueller ..... B26B 13/16 30/345
2011/0167642 A1 * 7/2011 Steele ..... B25B 7/14 81/319
2013/0199048 A1 * 8/2013 Fitraki ..... B26B 13/28 30/254
2014/0041491 A1 * 2/2014 Ying ..... B26B 13/16 81/319
2015/0062876 A1 * 3/2015 Brauner ..... B25B 7/22 362/119
2016/0144488 A1 * 5/2016 Buchanan ..... B25B 7/12 81/319
2016/0270299 A1 * 9/2016 Lin ..... A01G 3/025
2019/0001512 A1 * 1/2019 Wong ..... B26B 13/26
2019/0224817 A1 * 7/2019 Wu ..... B25B 13/50
2021/0122009 A1 * 4/2021 Wu ..... B25B 7/14
2021/0308883 A1 * 10/2021 Lindén ..... B26B 13/285
2021/0347013 A1 * 11/2021 Zhu ..... B25B 7/14
2022/0126466 A1 * 4/2022 Adachi ..... B26B 13/285

* cited by examiner

SCISSORS

RELATED APPLICATIONS

This application claims the benefits of Chinese Patent Application No. 202121465401.6, filed on Jun. 29, 2021, which is hereby incorporated by reference in this application.

FIELD OF THE INVENTION

The present invention relates to the technical field of cutting, and more particularly to a pair of scissors for opening a box.

BACKGROUND OF THE INVENTION

Scissors are a commonly used tool in people's daily life. They are usually used to cut sheet or linear objects such as cloth, paper, steel plate, rope. Scissors has double-blades. The two blades are staggered and can be opened or closed.

When people use boxes to pack objects, they generally use transparent tape or packaging tape at the sealing position of the box. A knife or scissors are used to cut the transparent tape or packaging tape to open the packaged box. Although the existing scissors can also be used to cut the transparent tape or packaging tape at the sealing position of the packaged box, it is necessary to open the two blades of the scissors relatively to each other and use one of the blades to cut. Compared with the knife, scissors are inconvenient to use, and because only one of the blades is used for cutting, the other one of the blades is exposed, which has safety hazard during operation. If the user does not operate properly, it is easy to scratch user's hands. There are also scissors that can be specially used to open box. The scissors include a first blade and a second blade. The first blade and the second blade are pivotally connected by a pin. The first blade and the second blade rotate relatively to each other. The first blade and the second blade can side relatively to each other, and then a torsion spring is arranged at the sliding position, so that the torsion spring is used to hinder the relative sliding between the first blade and the second blade. However, it is not only inconvenient to assemble the torsion spring, but the pin at the pivoting point of the scissors will also create friction when sliding.

In order to solve the above problems, it is necessary to provide a pair of scissors for opening the box.

SUMMARY OF THE INVENTION

Objective of the present invention is to provide a pair of scissors for opening a box with simple structure, low production cost and convenient operation.

To achieve the mentioned-above objective, a pair of scissors includes a first cutting member and a second cutting member, the first cutting member is provided with a first handle on an end thereof, and the second cutting member is provided with a second handle on an end thereof. The scissors further include a connecting nail and a movable hole defined on the first cutting member. The movable hole is arranged for the connecting nail to move, and the connecting nail passes through the movable hole and is connected with the second cutting member, so that the first cutting member pivots around the second cutting member by the connecting nail. The connecting nail is movable in the movable hole which allows the first cutting member to move relatively to the second cutting member.

In comparison with the prior art, the scissors for opening a box are provided with a movable hole in the first cutting member, and the movable hole is arranged for the connecting nail to move. The connecting nail passes through the movable hole and is connected with the second cutting member, so that the first cutting member pivots around the second cutting member by the connecting nail, thereby realizing relative close or open of the first cutting member and the second cutting member, so as to achieve the purpose of cutting by scissors. When the first cutting member and the second cutting member are closed, the connecting nail moves in the movable hole which allows the first cutting member to move back and forth relatively to the second cutting member between a retracted position and an extended position. When the first cutting member is at the retracted position, blade point of the second cutting member exceeds blade point of the first cutting member. Thus, the first cutting member and the second cutting member can be staggered. When the first cutting member is retracted, the blade point of the second cutting member can be exposed, and the second cutting member can be used to cut the transparent tape or packaging tape on the box to open the box. The scissors have simple structure, convenient operation and high safety. When the first cutting member is in the extended position, the blade point of the second cutting member is flush with the blade point of the first cutting member, and the first cutting member can be reset to the retracted position. In addition, the protective gasket can not only reduce the friction caused by the relative movement between the connecting nail and the first cutting member to protect the first cutting member, but also the connecting nail needs a certain driving force to move in the movable hole of the protective gasket, which avoids the wrong movement of the first cutting member and the second cutting member during use and causing accidental injury. Thus, the scissors are highly safe.

Preferably, the movable hole is defined on a cutting body of the first cutting member.

Preferably, the scissors further include a protective gasket, the protective gasket is disposed on the first cutting member, and the movable hole is formed on the protective gasket.

Preferably, the movable hole includes a pivot hole and a sliding gap, the connecting nail is rotatable in the pivot hole and slideable the sliding gap, the pivot hole is communicated with the sliding gap, and the sliding gap is arranged along a sliding direction of the first cutting member.

Preferably, the center of the pivot hole is located outside a symmetry axis of the sliding gap on the sliding direction of the first cutting member, so that a limiting portion is formed on a junction of the pivot hole and the sliding gap.

Preferably, the diameter of the pivot hole is greater than the width of the sliding gap.

Preferably, the protective gasket is extended towards the connecting nail to form a protruding strip, and the connecting nail is slidably arranged on the protruding strip.

Preferably, the first cutting member is provided with a mounting hole, and the protective gasket is mounted in the mounting hole. The protective gasket includes an inserting part and a bearing part that are connected to each other. The inserting part is inserted in the mounting hole and opened with the movable hole, and the bearing part is attached to an outer wall of the first cutting member. The connecting nail includes a connecting post and a cap, a lower end of the connecting post is connected to the second cutting member, an upper end of the connecting post is connected with the cap, the connecting post is movable in the inserting part, and a bottom surface of the cap is attached to the bearing part.

Preferably, the protective gasket further includes a pulling part extending outward from the bearing part, and the protective gasket is detached from the mounting hole of the first cutting member by pulling the pulling part.

Preferably, an inclined cutting surface is formed on an outer side of the second cutting member.

Preferably, the second cutting member includes an inner blade and a blunt outer blade which are connected to each other, the inner blade is located inside the blunt outer blade, and the inner blade is arranged along the sliding direction of the first cutting member.

Preferably, the scissors further include a locking mechanism. When the first cutting member and the second cutting member are in a closed state, the first cutting member moves relatively to the second cutting member between a retracted position and an extended position. When the first cutting member is at the retracted position, blade point of the second cutting member exceeds blade point of the first cutting member. Or, when the first cutting member is in the extended position, the blade point of the second cutting member and the blade point of the first cutting member are flush, and the locking mechanism locks the first cutting member and the second cutting member when the first cutting member is in the retracted position.

Preferably, the locking mechanism includes an engaging groove and an engaging portion. The engaging groove is opened in the first handle, the engaging portion protrudes from the second handle toward the first handle, and a matching portion is arranged in the engaging groove. When the first cutting member is in the retracted position, the engaging portion is inserted into the engaging groove and engaged with the matching portion to be locked.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings.

Figure 1:
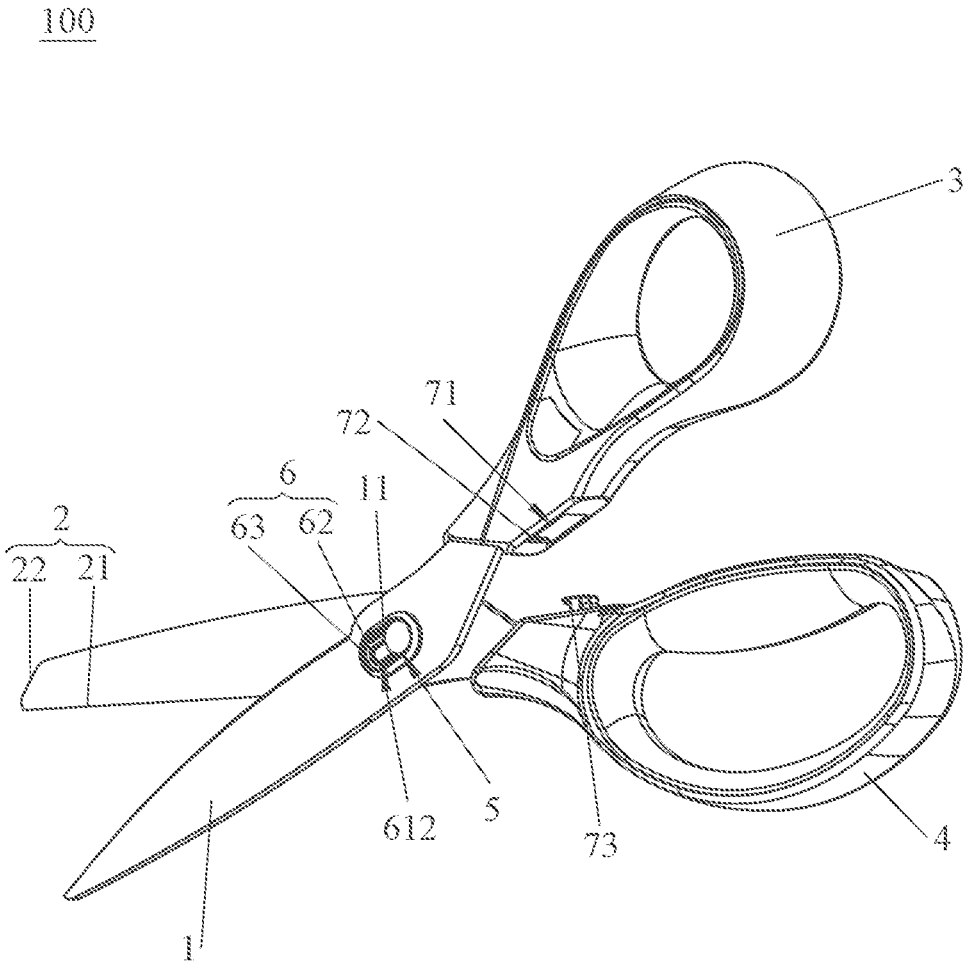
FIG. 1 is a perspective view of a pair of scissors according to an embodiment of the present invention.
Figure 2:
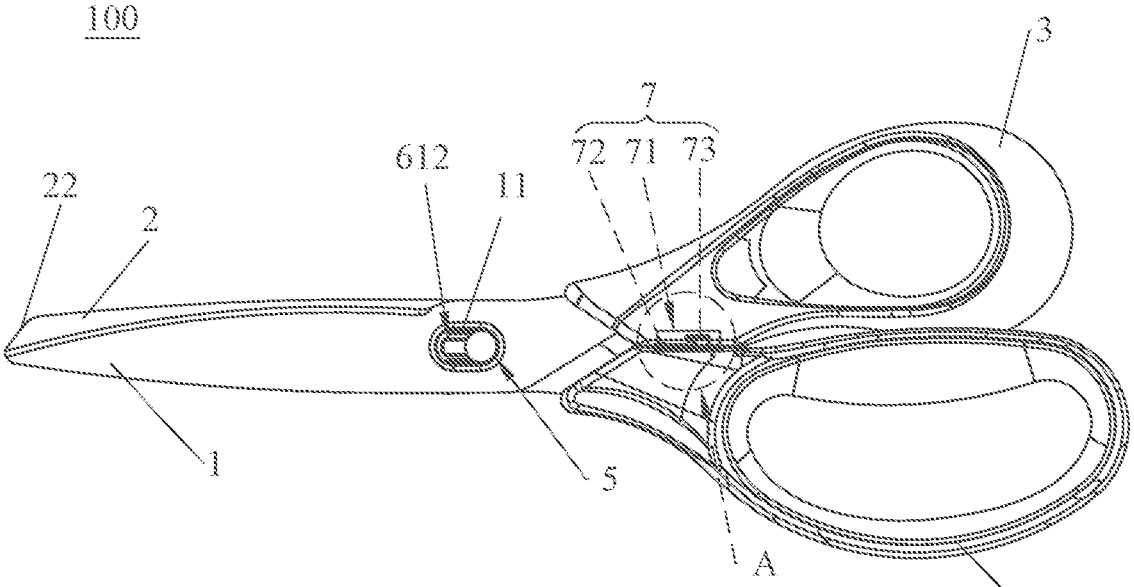
FIG. 2 is a front view of the scissors when the first cutting member of the scissors is at the extended position.
Figure 3:
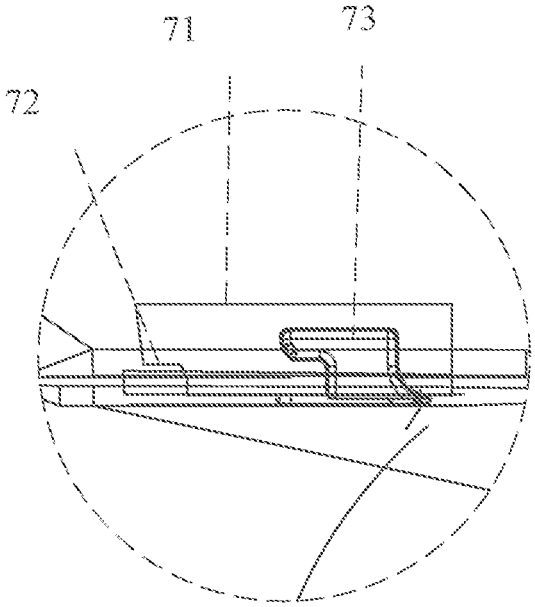
FIG. 3 is an enlarged view of section A in FIG. 2.
Figure 4:
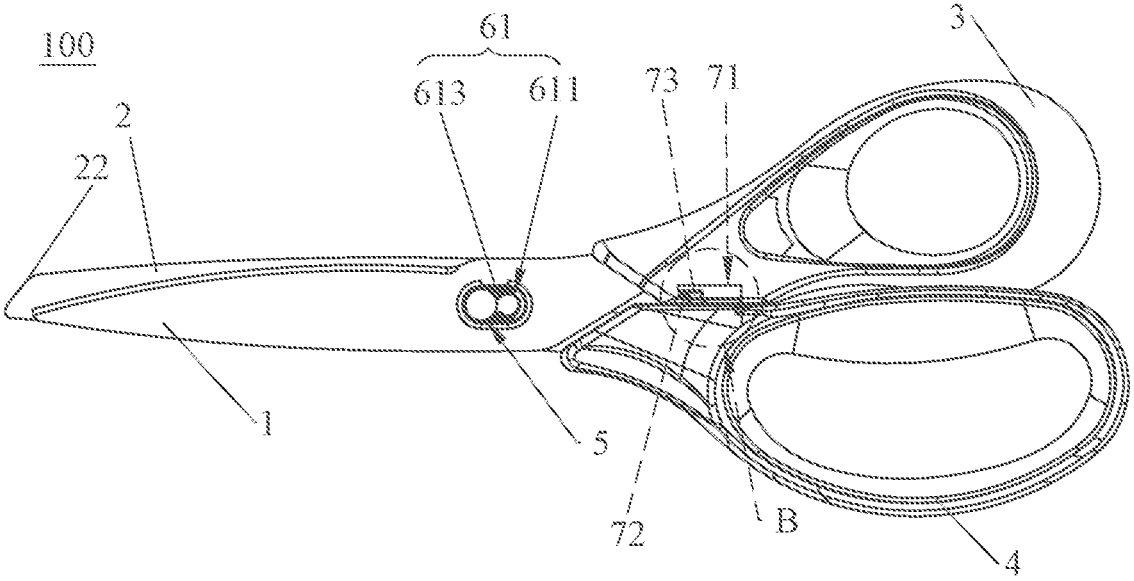
FIG. 4 is a front view of the scissors when the first cutting member of the scissors is at the retracted position.
Figure 5:
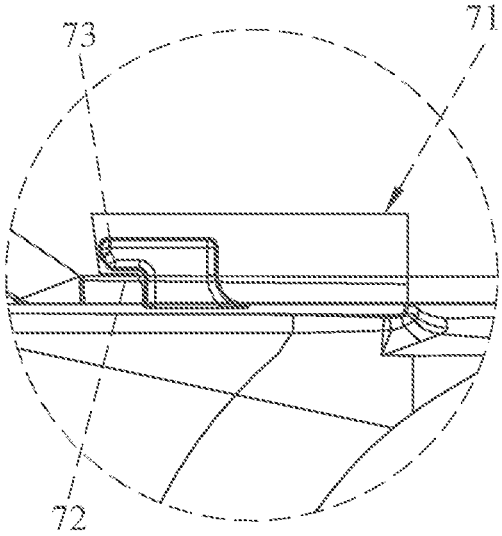
FIG. 5 is an enlarged view of section B in FIG. 4.
Figure 6:
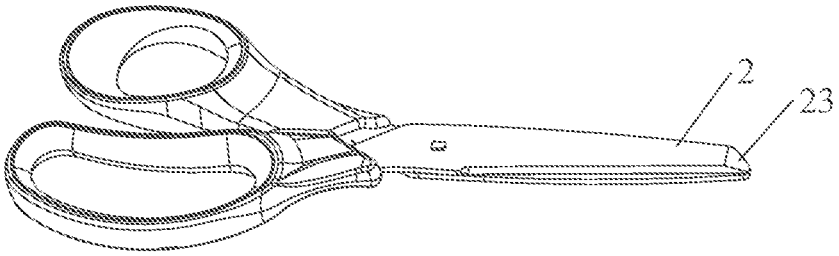
FIG. 6 is a perspective view of the scissors viewed from a different angle.
Figure 7:
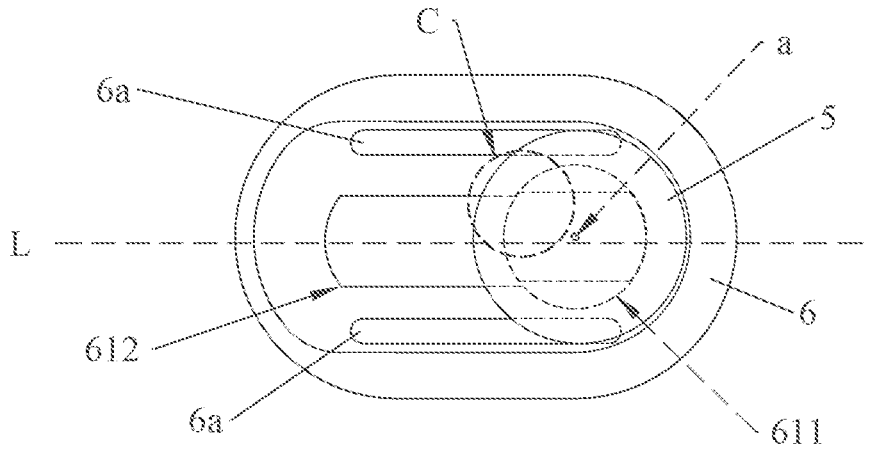
FIG. 7 is a front view of a connecting nail and a protective gasket according to an embodiment of the present invention.
Figure 8:
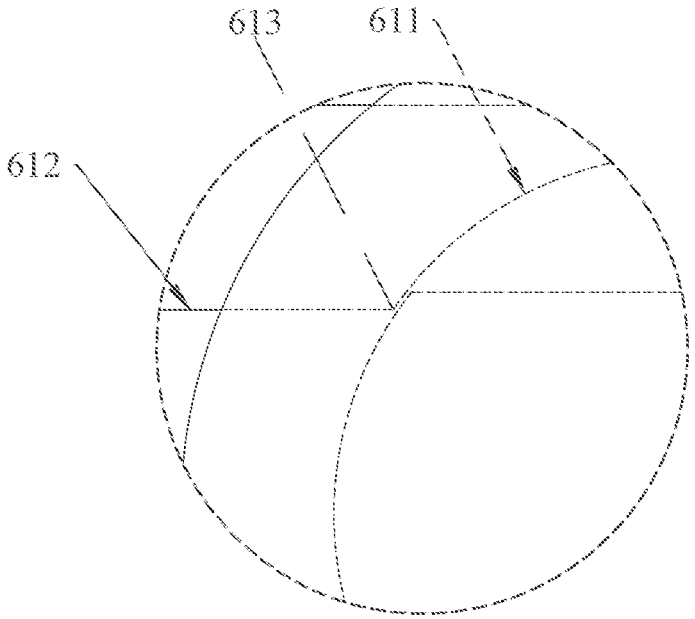
FIG. 8 is an enlarged view of section C in FIG. 7.
Figure 9:
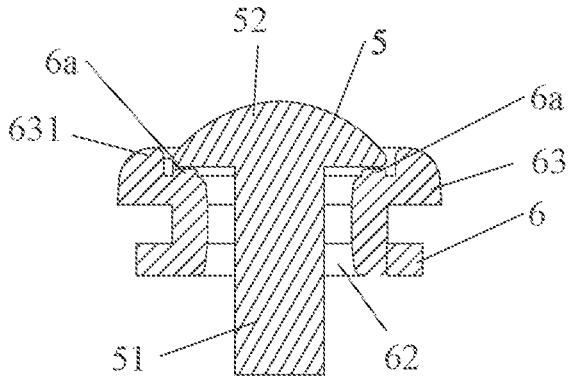
FIG. 9 is a cross-sectional view of FIG. 7 along a longitudinal direction.
Figure 10:
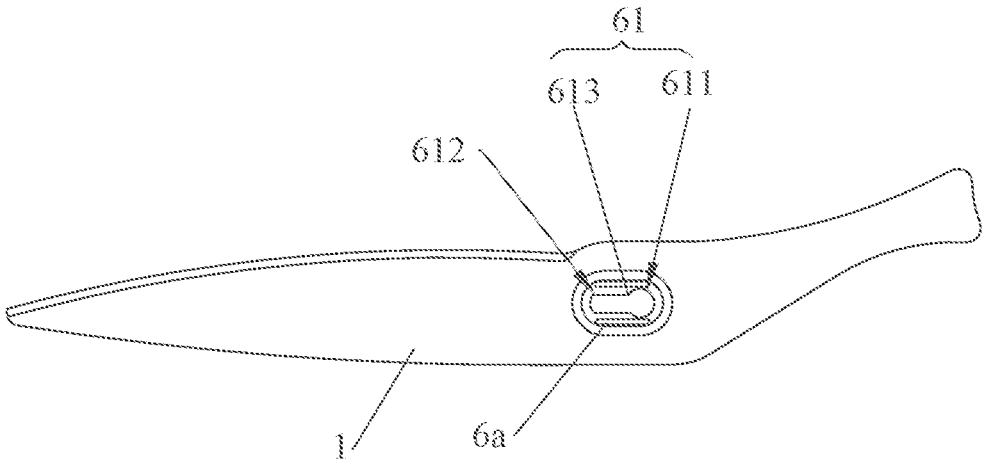
FIG. 10 is a perspective view of the first cutting member and the protective gasket.

As illustrated in FIGS. 1-5, a pair of scissors 100 for opening a box includes a first cutting member 1, a second cutting member 2, a connecting nail 5, and a protective gasket 6. The tail end of the first cutting member 1 is connected with a first handle 3, and the tail end of the second cutting member 2 is connected with a second handle 4. The first cutting member 1 and the second cutting member 2 can cut towards each other. The protective gasket 6 is disposed on the first cutting member 1 and has a movable hole 61 for the connecting nail 5 to move. The connecting nail 5 passes through the movable hole 61 and is fixedly connected to the second cutting member 2, so that the first cutting member 1 can pivot around the second cutting member 2 by the connecting nail 5, thereby realizing relative close or open of the first cutting member 1 and the second cutting member 2, so as to achieve the purpose of cutting by scissors. When the first cutting member 1 and the second cutting member 2 are closed, the connecting nail 5 moves in the movable hole 61 which allows the first cutting member 1 to move back and forth relatively to the second cutting member 2 between a retracted position and an extended position. When the first cutting member 1 is at the retracted position, blade point of the second cutting member 2 exceeds blade point of the first cutting member 1, as shown in FIG. 4. Thus, the first cutting member 1 and the second cutting member 2 can be staggered. When the first cutting member 1 is retracted, the blade point of the second cutting member 2 can be exposed, and the second cutting member 2 can be used to cut the transparent tape or packaging tape on the box to open the box. The scissors 100 have simple structure, convenient operation and high safety. When the first cutting member 1 is in the extended position, the blade point of the second cutting member 2 is flush with the blade point of the first cutting member 1, as shown in FIGS. 1-2, and the first cutting member 1 can be reset to the retracted position. At this extended position, the first cutting member 1 and the second cutting member 2 can be relatively pivoted to achieve cutting. In addition, the protective gasket 6 can not only reduce the friction caused by the relative movement between the connecting nail 5 and the first cutting member 1 to protect the first cutting member 1, but also the connecting nail 5 needs a certain driving force to move in the movable hole 61 of the protective gasket 6, which avoids the wrong movement of the first cutting member 1 and the second cutting member 2 during use and causing accidental injury. Thus, the scissors 100 are highly safe. Since the protective gasket 6 has a simple structure, it is not only convenient to assemble and easy to replace and maintain, but also to effectively reduce costs.

Figure 11:
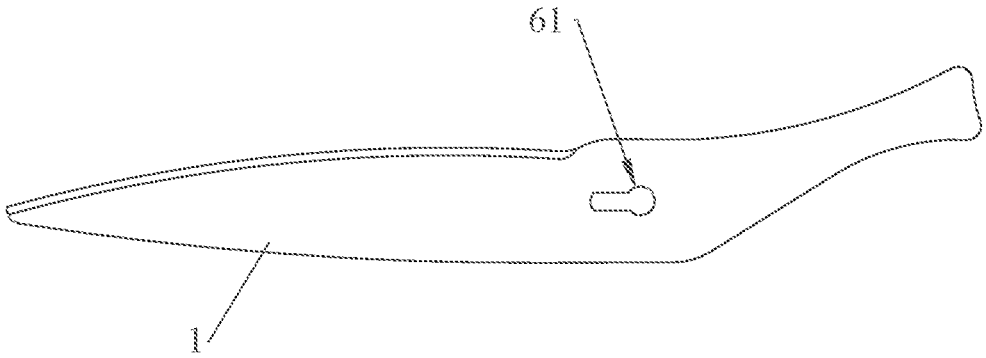
FIG. 11 is a perspective view of a pair of scissors according to another embodiment of the present invention.

It is understandable that in other embodiments, the movable hole 61 can also be directly opened on a cutting body of the first cutting member 1, that is, the protective gasket 6 is omitted, as shown in FIG. 11.

More specifically, referring to FIGS. 1 to 5 and FIGS. 7 to 10, the movable hole 61 includes a pivot hole 611 and a sliding gap 612. The pivot hole 611 is for the connecting nail 5 to rotate, thereby allowing the relative pivoting of the first cutting member 1 and the second cutting member 2 to achieve cutting. The connecting nail 5 can side in the sliding gap 612, so as to allow the first cutting member 1 to move back and forth relatively to the second cutting member 2, so that the first cutting member 1 can move between the retracted position and the extended position relatively to the second cutting member 2. The pivot hole 611 communicates with the sliding gap 612, and the sliding gap 612 is arranged along a sliding direction of the first cutting member 1, so that the first cutting member 1 moves more smoothly relatively to the second cutting member 2. Preferably, the pivot hole 611 is an arc-type hole, and the center al of the pivot hole 611 is located outside a symmetry axis L of the sliding gap 612 along the sliding direction of the first cutting member 1. That is, the center al of the pivot hole 611 is located on one side of the symmetry axis, and the pivot hole 611 is offset to one side of the second cutting member 2 so that a limiting portion 613, which is protruded outwardly, is formed on a junction of the pivot hole 611 and the sliding gap 612. The limiting portion 613 is used to make the connecting nail 5 to be stuck in the pivot hole 611 and a certain force is required to enable the connecting nail 5 to move from the pivot hole 611 to the sliding gap 612, which avoids the wrong movement of the first cutting member 1 and the second cutting member 2 during use and improves safety. Preferably, the diameter of the pivot hole 611 is larger than the width of the sliding gap 612, so that the scissors pivot more smoothly, and the scissors need to be pushed or pulled hard to slide, which is safer. Preferably, the protective gasket 6 is extended toward the connecting nail 5 to form a protruding strip 6*a*, and the connecting nail 5 is slidably arranged on the protruding strip 6*a*. The protruding strip 6*a* is arranged along the sliding direction of the first cutting member 1, the protruding strips 6*a* are symmetrically arranged on both sides of the movable hole 61, and the protruding strip 6*a* can reduce the contact area of the connecting nail 5 and the protective gasket 6, thereby achieving the effect of reducing friction.

Please refer to FIGS. 1 to 5 again, the first cutting member 1 is provided with a mounting hole 11, and the protective gasket 6 is mounted in the mounting hole. The protective gasket 6 includes a pulling part 631, an inner inserting part 62 and an outer bearing part 63 which are connected to each other. The inner inserting part 62 is inserted in the mounting hole and provided with the movable hole 61, and the outer bearing part 63 is attached to an outer wall of the first cutting member 1. The connecting nail 5 includes a connecting post 51 and a cap 52. A lower end of the connecting post 51 is connected with the second cutting member 2, an upper end of the connecting post 51 is connected with the cap 52, and the connecting post 51 is movable in the movable hole 61 on the inner inserting part 62. A bottom surface of the cap 52 is attached to the bearing part 631 thereby helping the connecting nail 5 to move more smoothly. The pulling part 631 extends outward from the outer bearing part 63, and the protective gasket 6 is detached from the mounting hole of the first cutting member 1 by pulling the pulling part 631. This arrangement not only improves the convenience of use. Preferably, the blade of the first cutting member 1 is "V"-shaped, and the blade of the second cutting member 2 includes a straight and sharp inner blade 21 and a blunt outer blade 22. The straight inner blade 21 and the blunt outer blade 22 are connected to each other, and the straight inner blade 21 is located inside the blunt outer blade 22. The straight inner blade 21 faces the first cutting member 1, and the straight inner blade 21 is arranged along the sliding direction of the first cutting member 1. The first cutting member 1 is sharply arranged to facilitate cutting, and the second cutting member 2 is arranged with a blunt surface to reduce the risk of scratching the user when the user opens the box.

As shown in FIGS. 1 to 6, the scissors 100 further include a locking mechanism 7. When the first cutting member 1 is in the retracted position, the locking mechanism 7 can lock the first cutting member 1 and the second cutting member 2 so that the scissors 100 are in a closed state to prevent the first cutting member 1 and the second cutting member 2 from opening and scratching the user's hand. The locking mechanism 7 includes an engaging groove 71 and an engaging portion 73. The engaging groove 71 is opened in the first handle 3, the engaging portion 73 protrudes from the second handle 4 toward the first handle 3, and a matching portion 72 is provided in the engaging groove 71. When the first cutting member 1 is at the retracted position, the engaging portion 73 is inserted into the engaging groove 71 and engaged with the matching portion 72 to be locked. When the first cutting member 1 is in the extended position, the first cutting member 1 and the second cutting member 2 are flush and can mutually rotate for cutting. Preferably, an inclined cutting surface 23 is formed on an outer surface of the second cutting member 2. The cutting surface 23 helps the scissors 100 to insert into the box to perform the cutting operation, and has a guiding effect.

Referring to FIGS. 1 to 5 again, a detailed description of the working process of the portable scissors 100 for opening the box will be given. When the first cutting member 1 is in the extended position relatively to the second cutting member 2, the blade point of the second cutting member 2 is flush with the blade point of the first cutting member 1, the connecting nail 5 is clamped in the pivot hole 611, and the first cutting member 1 pivots relatively to the second cutting member 2, the first cutting member 1 and the second cutting member 2 are relatively closed or opened to achieve the purpose of cutting by scissor 100. When the first cutting member 1 and the second cutting member 2 are closed, the connecting nail 5 moves in the sliding gap 612 of the movable hole 61 which allows the first cutting member 1 to move back and forth relatively to the second cutting member 2. When the first cutting member 1 is in the retracted position, the blade point of the second cutting member 2 exceeds the blade point of the first cutting member 1, so that the first cutting member 1 and the second cutting member 2 can be relatively staggered. When the first cutting member 1 is retracted, the blade point of the second cutting member 2 can be exposed, and the second cutting member 2 can be used to cut the transparent tape or packaging tape on the box to open the box. After opening the box, the first cutting member 1 moves relatively to the second cutting member 2 and is reset to the extended position.

By providing a protective gasket 6 on the first cutting member 1, the protective gasket 6 has a movable hole 61 for the connecting nail 5 to move. The connecting nail 5 passes through the movable hole 61 and is connected to the second cutting member 2, so that the first cutting member 1 can pivot around the connecting nail 5 and the second cutting member 2, thereby realizing relative close or open of the first cutting member 1 and the second cutting member 2, so as to achieve the purpose of cutting by scissors. When the first cutting member 1 and the second cutting member 2 are closed, the connecting nail 5 moves in the movable hole 61 which allows the first cutting member 1 to move back and forth relatively to the second cutting member 2 between a retracted position and an extended position. When the first cutting member 1 is in the retracted position, the blade point of the second cutting member 2 exceeds blade point of the first cutting member 1. Thus, the first cutting member 1 and the second cutting member 2 can be staggered. When the first cutting member 1 is retracted, blade point of the second cutting member 2 can be exposed, and the second cutting member 2 can be used to cut the transparent tape or packaging tape on the box to open the box. The scissors 100 have simple structure, convenient operation and high safety. When the first cutting member 1 is in the extended position, the blade point of the second cutting member 2 is flush with the blade point of the first cutting member 1, and the first cutting member 1 can be reset to the retracted position. In addition, the protective gasket 6 can not only reduce the friction caused by the relative movement between the connecting nail 5 and the first cutting member 1 to protecting the first cutting member 1, but also the connecting nail 5 needs a certain driving force to move in the movable hole 61 of the protective gasket 6, which avoids the wrong movement of the first cutting member 1 and the second cutting member 2 during use and causing accidental injury.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A pair of scissors, adapted for opening a box, the scissors comprising a first cutting member and a second cutting member, the first cutting member being provided with a first handle on an end thereof, and the second cutting member being provided with a second handle on an end thereof, wherein the scissors further comprise a connecting nail and a movable hole provided on the first cutting member, the movable hole is arranged for providing a space allowing the connecting nail to move, the connecting nail is inserted into the movable hole and is fixedly connected with the second cutting member, so that the first cutting member pivots around the second cutting member by the connecting nail, and the connecting nail is movable in the movable hole which allows the first cutting member to move relatively to the second cutting member;

wherein the movable hole comprises a pivot hole and a sliding gap, the connecting nail is rotatable in the pivot hole and slideable the sliding gap, the pivot hole is communicated with the sliding gap, and the sliding gap is arranged along a sliding direction of the first cutting member; the center of the pivot hole is located outside a symmetry axis of the sliding gap on the sliding direction of the first cutting member, so that a limiting portion is formed on a junction of the pivot hole and the sliding gap.

2. The scissors according to claim 1, wherein the movable hole is provided on a cutting body of the first cutting member.

3. The scissors according to claim 1, further comprising a protective gasket, the protective gasket being disposed on the first cutting member, and the movable hole being formed on the protective gasket.

4. The scissors according to claim 3, wherein the protective gasket is extended towards the connecting nail to form a protruding strip, and the connecting nail is slidably arranged on the protruding strip.

5. The scissors according to claim 3, wherein a mounting hole is directly formed the first cutting member, the protective gasket is mounted in the mounting hole, the protective gasket comprises an inserting part and a bearing part that are connected to each other, the inserting part has the movable hole and is inserted in the mounting hole, the bearing part is attached to an outer wall of the first cutting member, the connecting nail comprises a connecting post and a cap, a lower end of the connecting post is connected to the second cutting member, an upper end of the connecting post is connected with the cap, the connecting post is movable in the inserting part, and a bottom surface of the cap is attached to the bearing part.

6. The scissors according to claim 5, wherein the protective gasket further comprises a pulling part extending outward from the bearing part, and the protective gasket is detached from the mounting hole of the first cutting member by pulling the pulling part.

7. The scissors according to claim 1, wherein the diameter of the pivot hole is greater than the width of the sliding gap.

8. The scissors according to claim 1, wherein an inclined cutting surface is formed on an outer side of the second cutting member.

9. The scissors according to claim 1, wherein the second cutting member comprises an inner blade and a blunt outer blade which are connected to each other, the inner blade is located inside the blunt outer blade, and the inner blade is arranged along a sliding direction of the first cutting member.

10. The scissors according to claim 1, further comprising a locking mechanism, wherein when the first cutting member and the second cutting member are in a closed state, the first cutting member moves relatively to the second cutting member between a retracted position and an extended position; when the first cutting member is at the retracted position, blade point of the second cutting member exceeds blade point of the first cutting member; or, when the first cutting member is in the extended position, blade point of the second cutting member and blade point of the first cutting member are flush, and the locking mechanism is engaged with the first handle of the first cutting member to lock the first cutting member and the second cutting member when the first cutting member is in the retracted position.

11. The scissors according to claim 10, wherein the locking mechanism comprises an engaging groove and an engaging portion, the engaging groove is opened in the first handle, the engaging portion protrudes from the second handle toward the first handle, a matching portion is arranged in the engaging groove, and when the first cutting member is in the retracted position, the engaging portion is inserted into the engaging groove and engaged with the matching portion to be locked.

* * * * *